United States Patent [19]

Cropton

[11] Patent Number: 4,475,838

[45] Date of Patent: Oct. 9, 1984

[54] CLOSURE MEANS FOR A LIQUID

[75] Inventor: Rupert J. Cropton, Sunbury on Thames, England

[73] Assignee: Richardson-Vicks Inc., Wilton, Conn.

[21] Appl. No.: 54,783

[22] Filed: Jul. 5, 1979

[30] Foreign Application Priority Data

Feb. 15, 1979 [GB] United Kingdom ..... 7905378

[51] Int. Cl.[3] ..... A46B 11/02

[52] U.S. Cl. ..... 401/270; 222/420; 222/421; 222/563; 239/374; 401/186

[58] Field of Search ..... 401/270, 271, 272, 273, 401/276, 278, 132–135, 205, 232, 236, 183, 186; 222/420, 421, 563; 215/307, 31; 239/374

[56] References Cited

U.S. PATENT DOCUMENTS

| | | | |
|---|---|---|---|
| 2,310,777 | 2/1943 | Giavotto | 222/421 |
| 2,655,280 | 10/1953 | Cuttell et al. | 215/307 |
| 2,847,691 | 8/1958 | Edelstone et al. | 401/272 X |
| 2,913,749 | 11/1959 | Ayres | 401/271 X |
| 3,877,822 | 4/1975 | Lamura | 401/272 X |
| 3,915,577 | 10/1975 | Cropton | 401/270 X |

FOREIGN PATENT DOCUMENTS

| | | | |
|---|---|---|---|
| 358249 | 9/1922 | Fed. Rep. of Germany | 222/421 |
| 1333744 | 6/1963 | France | 215/31 |
| 793710 | 4/1958 | United Kingdom | 222/420 |

*Primary Examiner*—Steven A. Bratlie

*Attorney, Agent, or Firm*—George W. Rauchfuss, Jr.

[57] ABSTRACT

A liquid dispenser for attachment to or forming part of a liquid container including a bore and a plug portion of substantially the same cross-section as the bore mounted in and across the bore so that the outer surface of the plug and the inner surface of the bore are in sealing contact, the outer surface of the plug portion or the inner surface of said bore including a protrusion whereby the plug or brush holder are distorted to provide a liquid channel for control of the flow of the liquid between the outer surface of the plug and the inner surface of the bore.

9 Claims, 5 Drawing Figures

Figure 1:
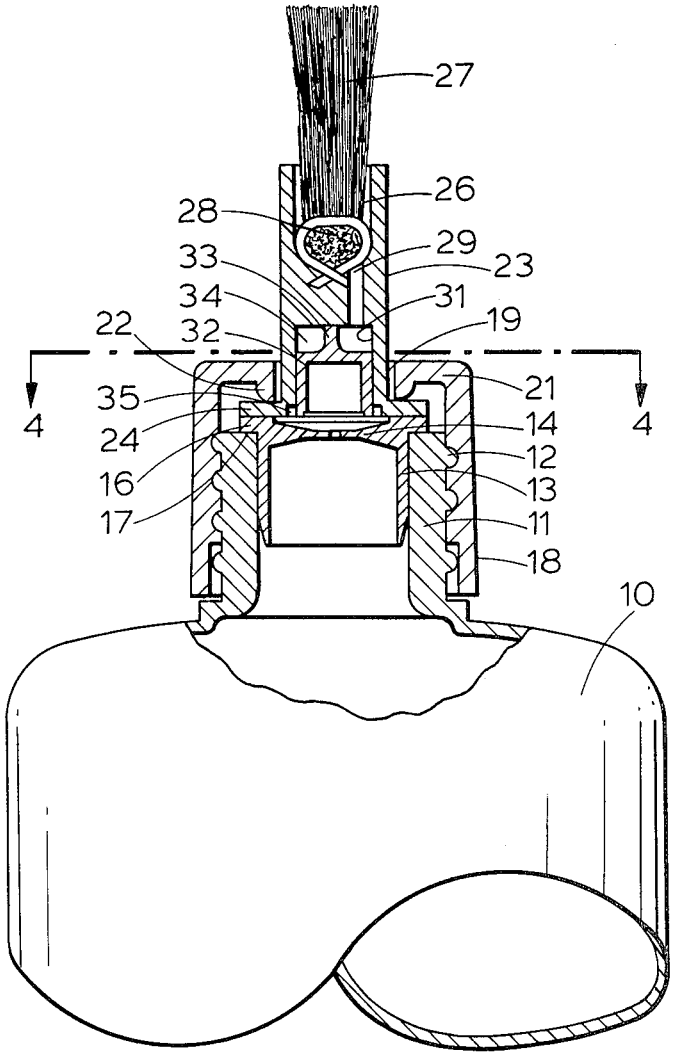

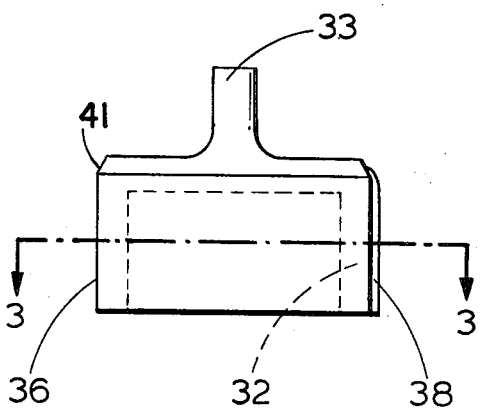
Fig. 2
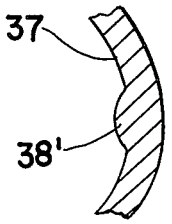
Fig. 5
Fig. 3
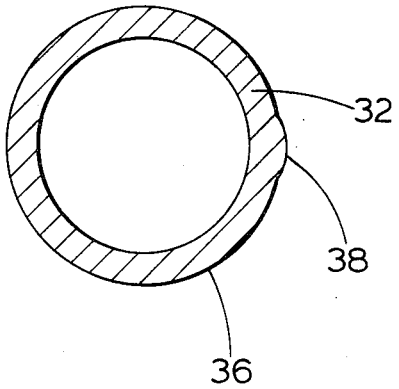
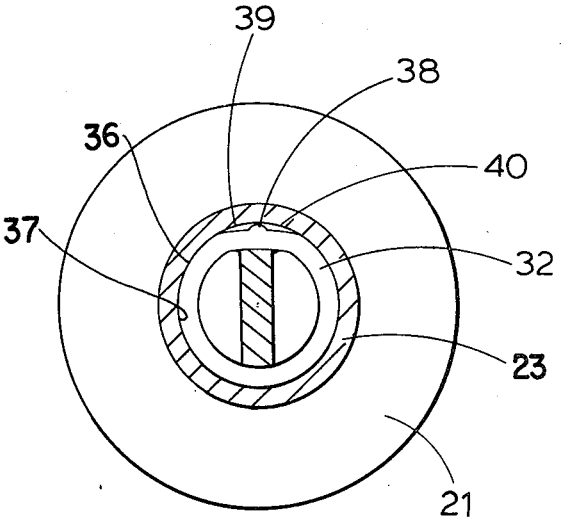
Fig. 4

CLOSURE MEANS FOR A LIQUID

The present invention relates to a liquid dispenser for attachment to or forming part of a liquid container. A liquid dispenser is shown in our earlier British Pat. No. 1,502,942.

Many attempts have been made to provide a simple and easily mouldable means for controlling the flow of fluid from the inside of a container and this has considerable use in, for example, containers for containing toiletries such as denture cleaner. Such containers and the means for controlling the flow must be very cheap to make since they are disposable containers and are therefore sold in very large numbers. In view of the low viscosity of the fluids being dispensed, which are typically aqueous solutions, any channel which is used to control the flow of the fluid must be of very fine bore, typically of the order of 0.1 mm in cross section and any means for controlling that fluid flow must be designed so as to be easily reproducable in a manufacturing environment.

Many means for controlling the fluid flow have been suggested. For example bores through solid material have been used but these are clearly very difficult to mould accurately and repeatably in large numbers. An improvement is to provide two surfaces and to provide a channel in one of the surfaces. This has worked reasonably successfully but there are still problems in providing, in a moulding tool, the necessary protrusion for producing such a channel. Furthermore, since the channel is moulded by means of a protrusion it has been found to be subject to damage when extracting the tool component. It is the common practice of mechanics to lever out the tool component with tools such as screw drivers which damage the protrusions on the mould. The lifetime of such a tool is limited.

The present invention is based on the realisation that the parts of a disposable container are generally produced of a flexible plastics material.

The present invention provides a liquid dispenser for attachment to or forming part of a container for a liquid comprising a brush holder having a bore of a predetermined cross section and a plug portion of substantially the same cross section as the bore, said plug portion being mounted in and extending across said bore so that the outer surface of the plug and the inner surface of the bore are generally in sealing contact, the outer surface of the said plug portion or the inner surface of said bore including a protrusion whereby the plug and/or brush holder are distorted to provide a liquid channel for control of the flow of the liquid between the outer surface of the plug and the inner surface of the bore in the brush holder. In this way, one moulds, for example, a circular cross section bore and plug one of which has a small protrusion which may be accurately moulded without difficulty to provide the liquid channel. The tool for moulding the bore or plug having the small protrusion simply needs a channel grooved in it to provide the small protrusion and this will not of course be subject to damage in the same way as a protrusion on the tool for moulding a channel in the surface of the previously used moulded article. Thus apart from the tool being easier to manufacture, it will last considerably longer than tools used to manufacture prior liquid dispensers thereby considerably reducing the manufacturing cost of the article.

It will be understood that the words "flow control" have a broad meaning in the present specification. Thus the words cover accurate control of the flow of a liquid in which the various parts would need to be accurately dimensioned or alternatively, the restriction of flow of the liquid from the interior of the container so as to prevent too much passing out of the container in normal use in which case normal manufacturing tolerances would suffice. In respect of the latter meaning there will be described a dispenser which includes an arrangement for preventing too much liquid from being passed out of the container by the user and this may be particularly useful in dispensing liquids from bottles of toiletries such as perfumes, shampoos and denture cleaners.

The protrusion preferably extends substantially axially.

A preferred embodiment of the invention will now be described by way of example only and with reference to the accompanying drawings in which:

FIG. 1 is a vertical section of a liquid dispenser according to the invention mounted on the neck of a container, only part of the container being shown, FIG. 2 is a side view of a plug alone of FIG. 1, FIG. 3 is a horizontal section through the plug on the lines 3—3 of FIG. 2, and, FIG. 4 is a horizontal section through the brush holder and plug portion on lines 4—4 of FIG. 1, and, FIG. 5 is a partial view similar to FIG. 3, but illustrating a modification of this invention.

Referring to FIG. 1 there is shown, in part, the top surface of a container 10 particularly adapted for containing a liquid for cleaning dentures, or for containing perfumes, shampoos and the like. The container 10 is of flexible plastics material and includes a neck portion 11 having a screw thread 12 on its outer surface.

Mounted within the neck portion 11 is a bung 13 of generally cylindrical cross section closed at its upper surface by a piercable membrane 14, the bung 13 being mounted in the neck portion 11 by means of outwardly extending shoulders 16 seating on the upper surface 17 of the neck portion 11. A plastics cap 18 having an internal screw thread engages with the screw thread 12. The cap 18 includes a bore 19 through its upper surface 21 the underneath of the upper surface 21 including a shoulder portion 22 of generally annular form. A brush holder 23 moulded of slightly flexible plastics material is provided which is generally cylindrical in section having at the lower end outwardly extending annular portion 24 which may be clamped between the shoulder 22 of the cap 18 and the upper surface of the bung 13 to thereby clamp the brush holder 23 in the position shown in FIG. 1. The brush holder 23 includes an upper bore 26 mounting a brush 27 by means of a staple 28. The base of the upper bore 26 communicates via a passage 29 with a lower bore 31. This lower bore 31 is circular in cross section and mounted therein is a plug 32 moulded of slightly flexible plastics material also of circular cross section of the same diameter as the bore 31. As will be seen the plug 32 includes a spacer member 33 to space it from the inner end of the lower bore 31 to thereby provide a chamber 34 between the upper surface of the plug 32 and the inner end of the lower bore 31 and so that the lower face of the plug 32 and shoulder 24 are generally coplanar.

The bore 31 includes at its lower end a counter bore 35 which provides an annular channel around the base of the plug 32. Furthermore the upper corner of the plug 32 is chamfered at 41 (See FIG. 2).

It is clear from FIG. 4 that the outer surface 36 of the plug 32 and the inner surface 37 of the lower end of holder 23 are generally in sealing contact with one another.

Referring now to FIGS. 2 and 3 it will be seen that the outer surface 36 of the plug 32 is not perfectly circular but includes a protrusion 38 which extends from the lower end of the plug 32 to its upper end (except for the spacer member 33) and is arranged to be generally parallel to the axis of the plug 32.

As is clear from FIG. 4 when the plug 32 is inserted into the bore 31 the plug 32 or the bore 31 is distorted (in the case illustrated the plug 32 is distorted) where the protrusion 38 is formed and it will be clear that liquid passages 38, 40 are provided on each side of the protrusion 38 through which liquid may pass in a controlled manner from the inside of the container to the chamber 34. Whether the plug or the bore will distort will depend upon their relative strengths which will depend upon the materials from which they are made (in a preferred arrangement polyethylene or polypropylene), their relative thicknesses and other factors.

As has been described earlier it is much simpler to mould accurately a protrusion rather than a depression and so the protrusion may be moulded very accurately in a manufacturing environment to provide an accurate restricted liquid path the same for all plugs moulded by the same mould to control the flow of liquid from the inside of the container to the brush 27.

At the base of the bore 31 the counter bore 35 overcomes problems which might arise from flash being formed at the lower surface of the plug or at the lower surface of the brush holder as is described in greater detail in our British patent specification No. 1,502,942.

In use, the container and closure means is transported with the piercable membrane 14 intact. Before use the cap 18 is removed together with the brush holder 23 and the piercable membrane 14 is pierced. The cap and brush holder are then reassembled in the manner shown in FIG. 1. In order to pass liquid from the interior of the container 10 to the brush 27 the container 10 is inverted and squeezed so that liquid passes from the interior of the container 10 through the pierced aperture in the piercable membrane 14, through the counter bore 35 to the restricted liquid passages 39, 40 into the chamber 34, through the passage 29 and thence to the brush 27.

In use, the passages 39, 40 are of very restricted width to restrict the flow of liquid and the protrusion 38 may extend from the true diameter of the plug (0.95 cm) to the extent of 0.12 mm.

Furthermore, instead of forming the protrusion on the outer surface of the plug it may equally well be formed on the inner surface 37 of the brush holder, as indicated by protrusion 38′ in FIG. 5. Furthermore, in some circumstances, the brush holder may form part of the container.

The invention is not restricted to the details of the foregoing example.

I claim:

1. In a liquid dispenser of flexible material for dispensing liquid from a container comprising a brush holder member having an inner surface defining a bore and a plug member mounted in the bore and having an outer surface, substantial portions of the inner and outer surfaces having circular cross-sections of the same diameter and being maintained in sealing contact with each other, the improvement comprising:

protrusion means extending substantially axially on one of the inner and outer surfaces for radially distorting circular cross-sectional portions of at least one of the inner and outer surfaces to interrupt the circular cross-sections thereof to form passage means therebetween for communicating the liquid therethrough.

2. The liquid dispenser of claim 1 wherein at least one of the plug member and the brush holder member is composed of a plastic material.

3. The liquid dispenser of claim 1 wherein the protrusion means comprises a single protrusion extending at least substantially parallel relative to a longitudinal axis of the bore.

4. The liquid dispenser of claim 1 wherein the protrusion means is on the outer surface of the plug member.

5. The liquid dispenser of claim 1 wherein the protrusion means is on the inner surface of the brush holder member.

6. The liquid dispenser of claim 1 wherein portions of the outer surface of the plug member adjacent the protrusion means are distorted to provide the passage means.

7. The liquid dispenser of claim 1 wherein portions of an outer surface of the brush holder adjacent the protrusion means are distorted to provide the passage means.

8. The liquid dispenser of claim 1 wherein portions of each of the inner surface of the brush holder member and the outer surface of the plug member adjacent the protrusion are distorted to provide the passage means.

9. The liquid dispenser of claim 1 wherein the passage means comprises a pair of circumferentially-spaced passages having the protrusion means disposed therebetween.

* * * * *